United States Patent [19]

Fischer

[11] Patent Number: 5,039,076

[45] Date of Patent: Aug. 13, 1991

[54] FOLDER

[75] Inventor: Emil Fischer, Oggersheim, Fed. Rep. of Germany

[73] Assignee: Albert-Frankenthal AG, Frankenthal, Fed. Rep. of Germany

[21] Appl. No.: 475,189

[22] Filed: Feb. 5, 1990

[30] Foreign Application Priority Data

Mar. 4, 1989 [DE] Fed. Rep. of Germany ..... 3906975

[51] Int. Cl.[5] ..... B42C 1/00

[52] U.S. Cl. ..... 270/47; 493/424; 270/50

[58] Field of Search ..... 270/47, 48, 49, 50; 493/424–435

[56] References Cited

U.S. PATENT DOCUMENTS

| | | | |
|---|---|---|---|
| 3,263,988 | 8/1966 | Heimlicher | 270/50 |
| 3,477,709 | 11/1969 | Neal | 493/424 |
| 4,437,855 | 3/1984 | Bullen | 270/50 |
| 4,496,338 | 1/1985 | Michalik | 493/426 |
| 4,936,561 | 6/1990 | Mukai | 270/47 |

FOREIGN PATENT DOCUMENTS

| | | | |
|---|---|---|---|
| 2309919 | 5/1974 | Fed. Rep. of Germany | 493/429 |

*Primary Examiner*—Edward K. Look
*Assistant Examiner*—Therese M. Newholm
*Attorney, Agent, or Firm*—Edwin D. Schindler

[57] ABSTRACT

In the case of a folder with at least two folding cylinders having cooperating folding members in the form of folding blades and folding jaws and intended for processing products of very different thickness, more reliable operation may be achieved if at least one folding cylinder has circumferential sections which are able to be adjusted in the radial direction.

15 Claims, 3 Drawing Sheets

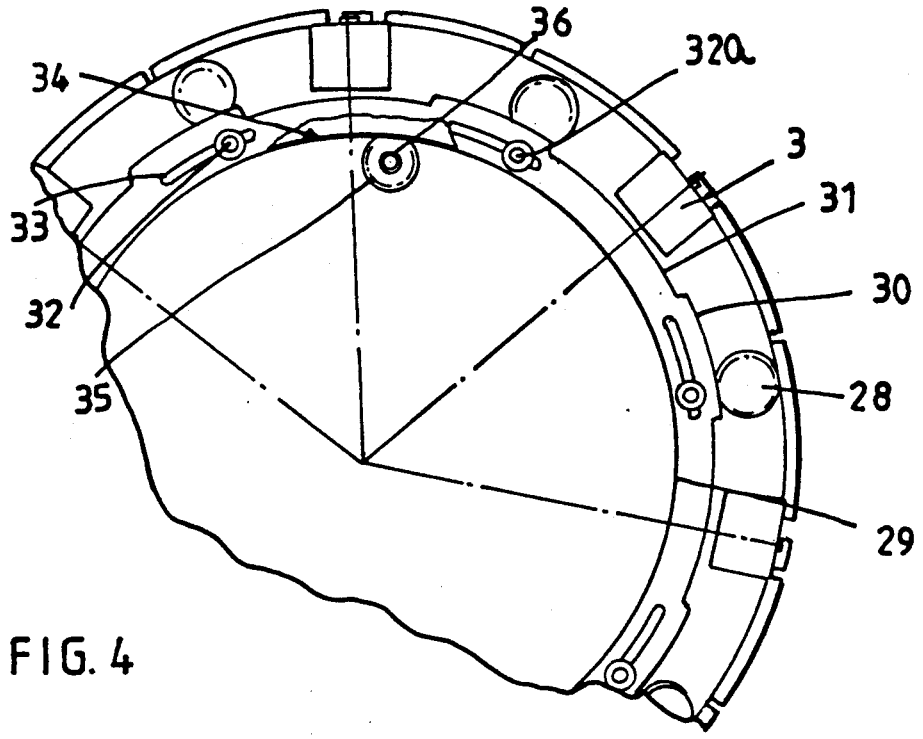
FIG. 4
FIG. 5
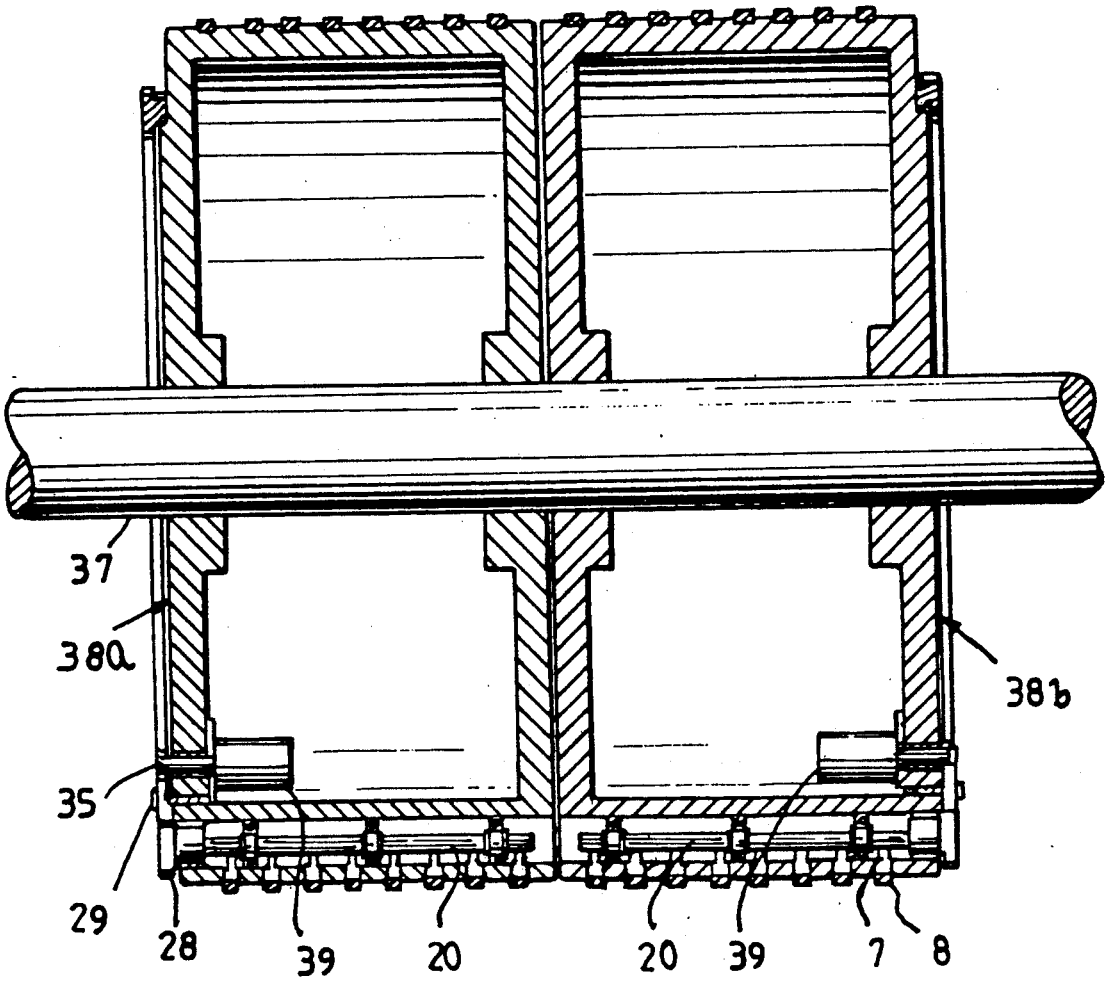

FOLDER

BACKGROUND OF THE INVENTION

The invention relates to a folder with at least two folding cylinders provided with cooperating folding members in the form of folding blades and, respectively, folding jaws.

In known arrangements of this type the folding cylinders are held at a certain distance from each other so as to leave a fixed gap through which the products to be processed have to pass. The size of gap is in this case adapted to suit the thickness of the product, normally in such a manner that the gap is somewhat undersize in relation to the thickness, such undersize being allowed for by the elasticity of an elastic cylinder cover. This however only leads to satisfactory operation when the product has a certain thickness. If the thickness of the product is less than rated for there is no reliable engagement with the surface of the cylinder. If the product has a greater thickness than envisaged the greater surface pressure will lead to a ruck or pucker in the elastic cover and such ruck or wave may entail displacement of the products. More especially in the case of folders of double width with two production lines placed side by side for products of different thickness severe difficulties may be expected.

SHORT SUMMARY OF THE INVENTION

Taking this state of the art as a starting point, one object of the present invention is thus to evolve a folder of initially specified type which is so improved that the effective gap width may be adapted to the different thickness of different products.

In order to achieve this or other objects appearing in the present specification, claims and drawings, at least one folding cylinder has circumferential sections which are adjustable in a radial direction.

These measures means that the initially noted disadvantages may be completely overcome. The features of the invention thus make it possible to process products with very great differences in thickness while nevertheless ensuring the same accuracy of product and gentle handling thereof. Thus the measures provided by the invention lead to a not inconsiderable widening of the field of application of a folder of the initially mentioned type and thus by and large lead to improved economics of production.

It is convenient if the folding cylinder having the folding jaws has the radially adjustable circumferential sections, since the length of the products resting on the folding jaw cylinder is reduced to half the cut length owing to the folding operation. It is thus sufficient if the circumferential zone between the suceeding folding members is divided into two sections, of which only the section coming after the adjacent folding member is able to be set in the radial direction and the other one is fixedly placed.

In accordance with another convenient feature in accordance with the invention the sections able to be adjusted in the radial direction have rails which are placed adjacent to each other with a space in between them and ganged for radially outward motion, such rails preferably bearing an elastic cover. This simplifies the mechanical design, since the rails may be simply arranged to be moved inwards and outwards. For this purpose the rails may conveniently be provided so as to rock about a pivot axis which is parallel to the cylinder axis and is adjacent to the leading end of the rail.

It is an advantage if the rails are arranged so as to be able to slide in the radial direction and rock on a respectively provided pin fixed to the cylinder and having a return spring placed about it so that on the one hand there is engagement with a support surface on the cylinder and on the other hand there engagement with setting device provided on the cylinder. These developments lead to a particularly simple and sturdy structure while at the same time making the folder simple to attend to. The setting device may simply take the form of an eccentric shaft running along the associated rails in parallelism to the cylinder axis and which is able to be turned by means of a turning device and is able to be set by means of a clamping device, this ensuring a simple and straightforward design and great simplicity of use.

The invention further contemplates an arrangement in which all eccentric shafts mounted on one cylinder are provided with lateral drive wheels, the drive wheels provided adjacently to an end face of the cylinder being able to come into engagement with a common setting ring coaxial to the cylinder. This feature means that there is the advantage of ganged adjustment of all the eccentric shafts.

Further advantageous features and convenient developments, of the invention will be gathered from the claims.

Working embodiments of the invention will now be explained in detail wit reference to the drawings.

LIST OF THE SEVERAL VIEWS OF THE DRAWINGS

FIG. 4 is an end-on view of a folding jaw cylinder provided with a setting ring.

FIG. 5 is a longitudinal section taken through a double-width folding jaw cylinder in accordance with the invention.

DETAILED DESCRIPTION OF WORKING EMBODIMENT OF THE INVENTION

Figure 1:
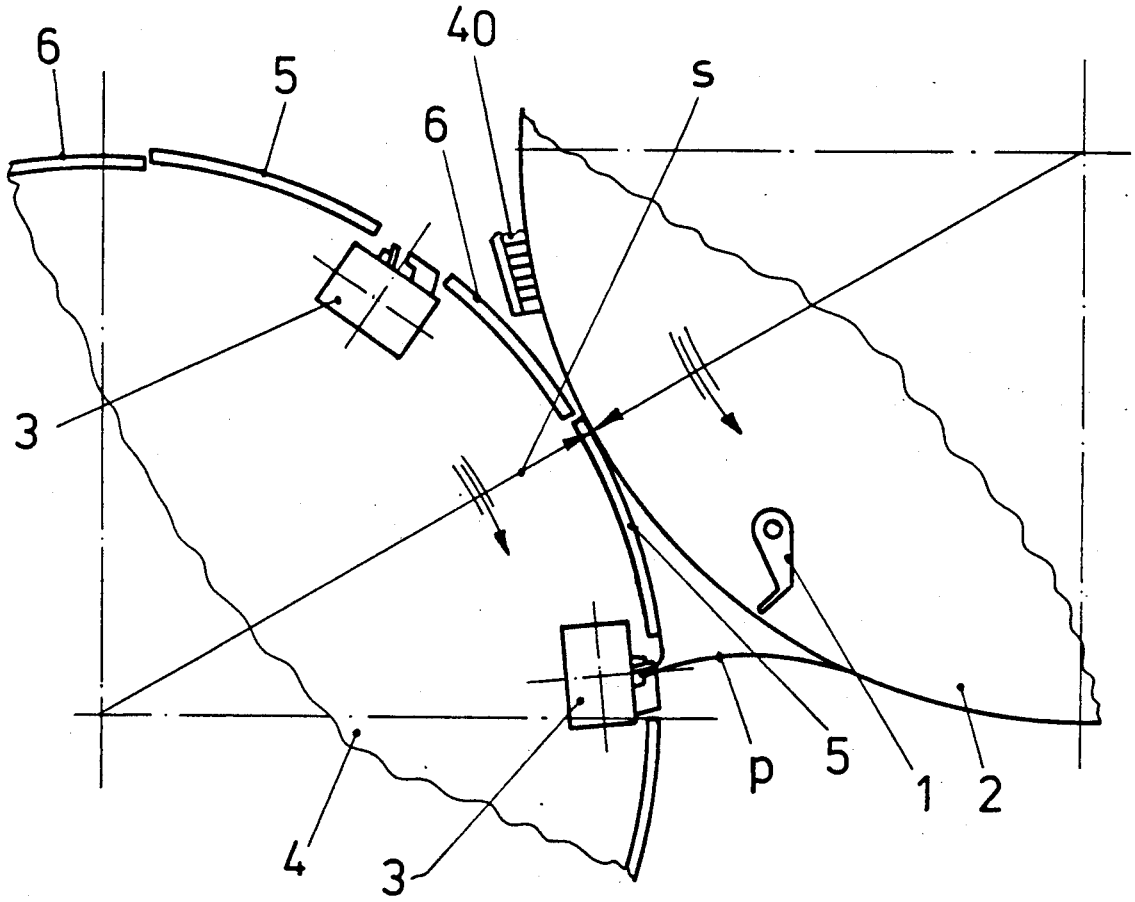
FIG. 1 is a partial side elevation of a transverse folding unit composed of a folding blade cylinder and a folding jaw cylinder.

The general structure and workings of folders for sheet products being familiar to those in the art, the present account is generally restricted to the novel features of the present invention. The main part of a folder 1 is a transverse folding unit of the type shown in FIG. 1. The transverse folding unit comprises a folding blade cylinder 2 armed with folding blades 1, and a folding jaw cylinder 4 bearing folding jaws 3 for cooperation with the folding blades 1. The two cylinders 2 and 4 are so driven that they are in rolling relationship with each other at the same surface speed with gap s between them. Between the two cylinders 2 and 4 there is a gap s whose width is equal to the thickness of the unfolded product P of is slightly undersize in relation thereto so that the products P passing through the gap s are reliably pressed on to the surface of the folding blade cylinder 2.

In order to be in a position to process products with different thicknesses, the width off the gap s is able to be adjusted. For this purpose the circumferential zones between the succeeding folding jaws 3 are respectively subdivided into two sections 5 and 6, of which the section 5 which leads in the direction of rotation, that is to say the section 5 adjacent to the folding jaw 3 which leads in the direction of rotation, is such that at least its trailing end is able to be adjusted in the radial direction. The result of this is a modification of the diameter of the folding jaw cylinder at the circumferential section 5 This alteration prevents the gap s from being excessively large or small.

Figure 3:
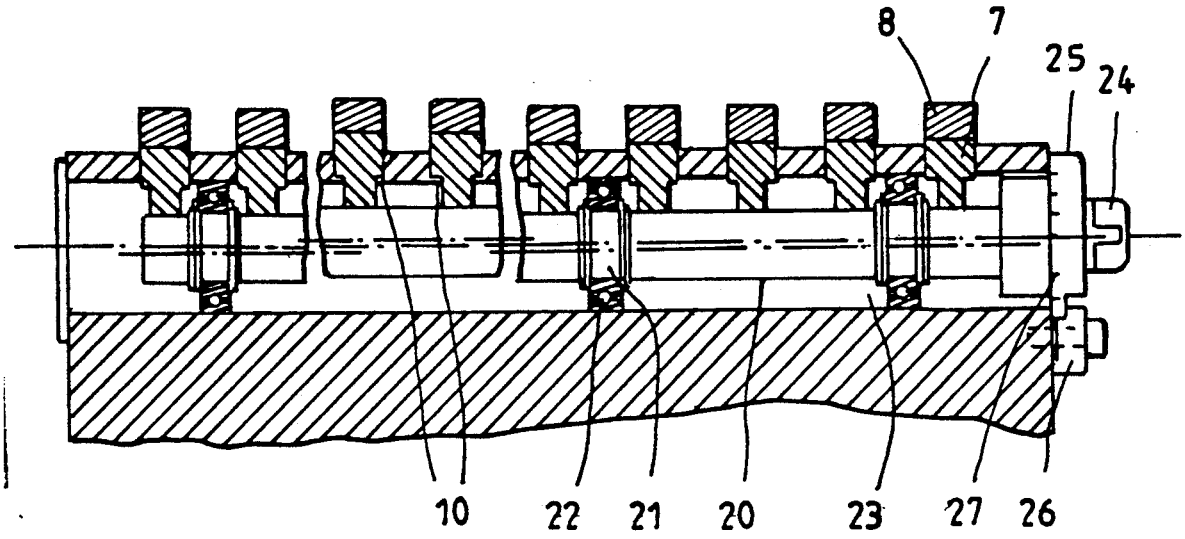
FIG. 3 is a partial longitudinal section taken through the folding blade cylinder as in FIG. 2.
Figure 2:
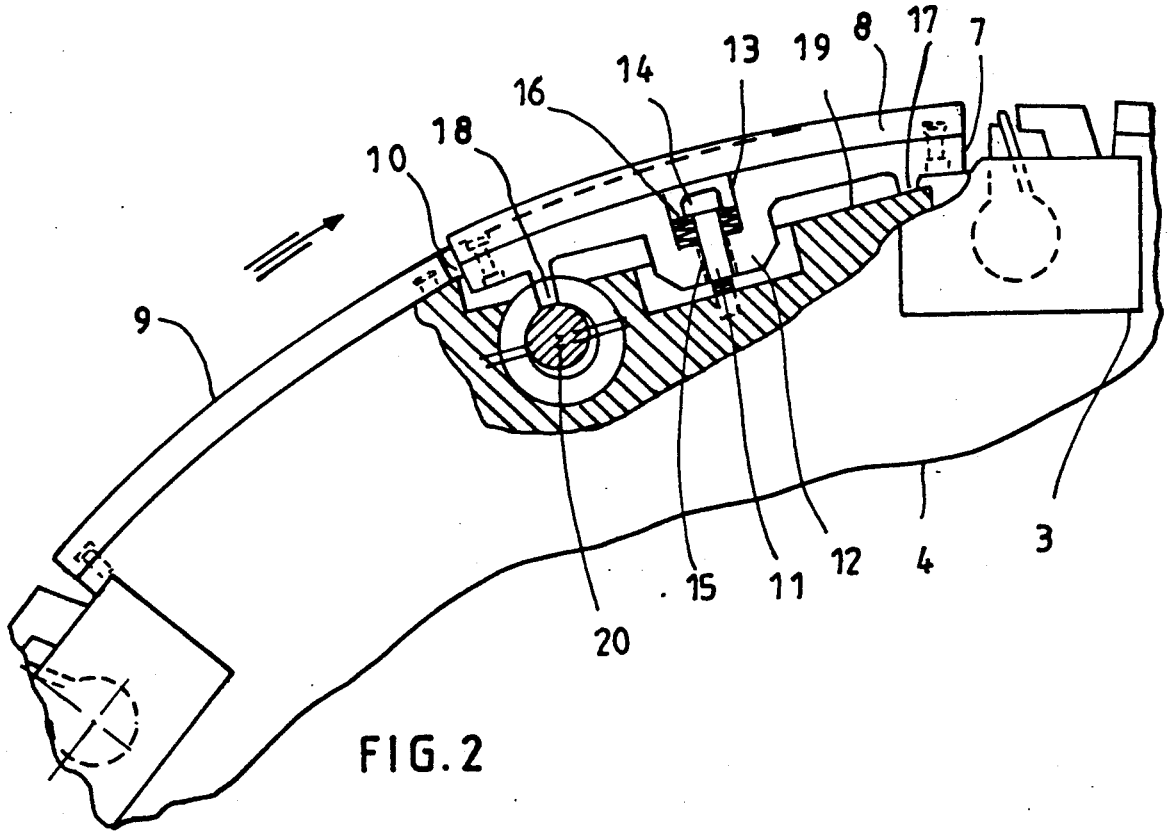
FIG. 2 is a partial end-on view of the folding blade cylinder, partly in section.

As the reader will see from FIGS. 2 and 3, the adjustable circumferential sections 5 are constituted by spaced, curved rails 7 arranged with an equal spacing over the breadth of the cylinder. These rails are provided with an elastic cover 8 and are able to be jointly moved outwards in the radial direction. At the stationary circumferential sections 6 it is possible to provide strips 9 forming an extension of the rails 7 and consisting, like the cover 8, of elastic material. The mutually spaced rails 7 are fitted in associated circumferential slots 10 and may be moved into and out of the same. In the retracted position there is the circumferential outline as indicated in broken lines in FIG. 2, which merges practically without any step with the strips 9 arranged in a fixed manner on the circumference of the cylinder. In the outwardly moved setting indicated in full lines in FIG. 2 the rails 7 have their ends which are trailing in the direction of rotation, radially rocked outwards so that there is a step between them and the adjacent, fixed strips 9. The increase in diameter of the folding jaws cylinder 4 produced in this manner provides for reliable pressing engagement on the surface of the folding blade cylinder 2 even when working on very thin products. Normally the rails 7 are rocked so far outwards that the minimum width of the gap 2 is undersize by 0.5 mm in relation to the thickness of the product when the rear ends of the rails 7 move past the adjacent folding blade cylinder. This undersize is allowed for by deformation of the elastic strips 8.

As may furthermore be seen from FIG. 2, the rails are able to be adjusted in a radial direction and in a pivoting manner by being mounted on a radial pin 11 which is fixed in relation to the cylinder and is provided for each respective rail. For this purpose the rails 7 are provided with a support 12 having the respectively provided radial pin 11 extending through it and undercut to provide a chamber-like recess 13, into which there extends the end of the respectively associated radial pin 11. This pin has a head 14 at this end. The yoke of the support 12 is provided with a hole 15 through which the shank of the associated radial pin 11 extends. The hole 15 is oversize in relation to the diameter of the shank so that the respective rail 7 is able to rock. The end, extending into the recess 13, of the radial pin 11 is within a stack of spring washers 16, whose one end bears against the head 14 and whose other end bears against the yoke of the support 12 fitting under the head 14. At their leading and trailing ends the rails 7 are provided respectively with a supporting foot 17 and, respectively, 18. The leading support foot 17 rests on a support surface 19 on the cylinder side. The trailing supporting foot 18 engages an eccentric shaft 20 parallel to the axis of the cylinder and which is able to be turned for outwardly pivoting the rails 7 respectively forming one adjustable circumferential section 5. When the rails 7 are rocked outwards the stack of springs 16 is compressed. This spring means accordingly acts as a return spring.

The eccentric shaft 20, which is parallel to the cylinder axis, extends across the full cylinder width in the case of single-width cylinders so that all rails, which are evenly distributed over the cylinder width, of an adjustable circumferential section 5 are able to be set in a ganged manner. The eccentric shaft 20 is, as may best be seen from FIG. 3, provided with eccentric collars 21 carried in anti-friction bearings 22, which for their part are received in an associated hole 23 in the cylinder near the circumference. In the illustrated working embodiment of the invention at one end of the cylinder the eccentric shaft 20 is provided with a projecting square end 24, to which a key may be applied to turn it. The square end 24 extends past one collar 25 serving as an axial bearing and which rests against the end face of the cylinder and may be clamped in position by a sprag 26 in order to lock it in the setting which has been made. In order to facilitate setting the collar 25 is in the form of a scale member having a scale 27 and which may cooperate with an index mark on the cylinder, for example in the form of a notch.

If the folding jaw cylinder 4 is provided with a plurality of folding jaws 3 on the circumference and is accordingly provided with a number of adjustable circumferential sections 5, then to facilitate operation it is possible to have an actuating device operatively associated with all the eccentric shafts. In such a case the eccentric shafts 20 may, as will best be seen from FIG. 4, be respectively provided with a lateral drive wheel 28, all such drive wheels 28 being in engagement with a common setting ring 29 which is coaxial to the cylinder. In the illustrated working example of the invention the setting ring 29 is provided with circumferential racks 30 each meshing with an associated drive wheel 28. The racks 30 have circumferential recesses 31 between them as interruption and which have boxes of the cylinder fitting in them in order to receive the folding jaws 3. The setting ring 29 arranged at the end of a cylinder is received on pins 32 on the cylinder which fit into arcuate slots 33 therefor. At least one of the pins 32 is designed in the form of a clamping screw **32*a* by which the setting ring 29** may be locked in place.

The setting ring 29 may be turned by hand. In the illustrated working embodiment the setting ring 29 is provided with teeth 34 on its inner periphery, such teeth being engaged by a setting wheel 35 bearinged at the cylinder end and which may have a hex outline for engagement by a spanner.

However it is also possible to drive the setting ring 29 by means of an associated motor. Such a design is shown in FIG. 5. In this case it is a question of a double-width folding jaw cylinder with two cylinder section **38*a* and 38*b* which are arranged on a common shaft 37 and are able to be driven independently of each other. The rails 7 arranged in the two cylinder sections 38*a* and 38*b* and able to be moved in the radial direction inwards and outwards have an elastic cover and are respectively able to be actuated separately from the rails of the adjacent cylinder section. The basic structure is in this respect essentially the same as the design shown in FIG. 2, the eccentric shaft 20 not extending over the entire cylinder width but only along the associated cylinder section 38*a*, 38*b*. The eccentric shafts 20 of the two cylinder sections 38*a* and 38*b* are provided with drive means respectively placed at the two cylinder end faces which are remote from each other. The latter are the same as in the embodiment shown in FIG. 4 with the difference however that the setting wheel 35 meshing with the setting ring 29 is driven by a respectively associated drive motor 39**, which in the present case is arranged in the interior of the cylinder or, respectively, of the respectively cylinder and is internally mounted on the respective end wall.

Owing to the fact that only the trailing ends of the circumferential sections 6 are able to rock outwards radially it is possible to ensure that only the trailing ends of the products p are pressed on the cylinder 2 after the product has ceased to be guided by guide means 40 such as brushes, belts and the like provided on the inlet side of the gap between the cylinders 2 and 4. The product may then be guided. On the other hand the limitation of the pressing action to the rear end of the product ensures that the crushing and rubbing action performed by the sections 6 is limited and that damage to the products such as scoring is precluded.

I claim:

1. A folder, comprising:

at least two folding cylinders having cooperating folding members in the form of folding blades and folding jaws, at least one of said folding cylinders being provided with circumferential sections; and, setting means for adjusting said circumferential sections in a radial direction wherein said circumferential sections are arranged and tiltable about an axis parallel to the cylinder axis provided in an area of a leading end of said circumferential sections and with a tailing end of said circumferential sections being extendable in a radial direction by means of said setting means.

2. The folder as claimed in claim 1, wherein the folding cylinder provided with folding jaws comprises circumferential section which are adjustable in a radial direction.

3. The folder as claimed in claim 1, wherein a circumferential zone between succeeding folding members is subdivided into two respective sections, of which the section following the adjacent folding member is able to be adjusted in the radial direction and the other section is arranged in a fixed manner.

4. The folder as claimed in claim 1, wherein the section which are able to be adjusted in the radial direction comprise spaced rails which are able to be jointly moved in a radial direction and which are provided with an elastic cover, said spaced rails being adapted to be movable out from associated circumferential slots and the non-adjustable cylinder sections have lands which are formed by elastic strips which are arranged so as to form extensions of the spaced rails.

5. The folder as claimed in claim 1, wherein cylinders comprises radial pins having return springs surrounding them and having spaced rails, which are able to be jointly moved in a radial direction and which are provided with an elastic cover, said spaced rails being mounted on said return springs for radial sliding and rocking motion, said rails, on the one hand, bearing on a support surface on the cylinder and, on the other hand, on said setting means provided on the cylinder, said spaced rails being provided with supporting feet bearing on the supporting surface and, respectively, on the setting device, such feet being located adjacent the ends of said spaced rails, said setting means being capable of moving said spaced rails outwardly against the action of said return spring, said setting means further comprising an eccentric shaft extending parallel to the cylinder axis along the associated spaced rails and which is able to be turned by means of a turning device and locked by means of a clamping device.

6. The folder as claimed in claim 5, wherein said eccentric shafts comprise lateral drive wheels and wherein said drive wheels provided adjacent to a cylinder end are in engagement with a common setting ring coaxial to the cylinder axis, said setting ring comprising racks associated with the drive wheels for cooperation therewith and spaced out by circumferential recesses into which the folding member fit, said setting ring further comprising internal gear teeth and a setting wheel meshing with said internal gear teeth.

7. The folder as claimed in claim 1, wherein said folding cylinders are subdivided centrally and in each resulting cylinder section is provided separately operated folding members, the circumferential sections being adjustable in a radial direction with the adjacently placed cylinder sections being able to be separately operated.

8. The folder as claimed in claim 7, wherein said setting means moves spaced rails outwardly against the action of a return spring, the circumferential sections being adjustable in a radial direction and comprising the spaced rails, said setting means further comprising an eccentric shaft extending parallel to the cylinder axis along the associated spaced rails, said eccentric shaft being fully extended along the width of the associated cylinder section and being arranged to be driven from an opposite cylinder end surface.

9. A folder, comprising:

at least two folding cylinders having cooperating folding members in the form of folding blades and folding jaws, at least one of said folding cylinders being provided with adjustable circumferential sections trailing the folding members and between successive folding members, said adjustable circumferential sections being formed by spaced rails with sai spaced rails being arranged adjacent one another with spacings therebetween and jointly projectable in a radial direction and, further, with fixed strips extending said rails and forming non-adjustable circumferential sections; and, setting means for adjusting said adjustable circumferential sections in a radial direction wherein said adjustable circumferential sections are arranged and tiltable about an axis parallel to the cylinder axis provided in an area of a leading end of said adjustable circumferential sections and with a tailing end of said adjustable circumferential sections being extendable in a radial direction by means of said setting means.

10. The folder as claimed in claim 9, wherein said rails are provided with an elastic coating and said fixed strips are formed by strips comprising an elastic material.

11. The folder as claimed in claim 9, wherein the folding cylinder provided with folding jaws comprises adjustable circumferential section which are adjustable in a radial direction.

12. The folder as claimed in claim in claim 9, wherein cylinders comprise radial pins having return springs surrounding them and having spaced rails, which are able to be jointly moved in a radial direction and which are provided with an elastic cover, said spaced rails being mounted on said return springs for radial sliding and rocking motion, said rails, on the hand, bearing on a support surface on the cylinder and, on the other hand, on a setting means provided on the cylinder, said spaced rails being provided with supporting feet bearing on the supporting surface and, respectively, on the setting means, such feet being located adjacent the ends of said spaced rails, said setting means being capable of moving said spaced rails outwardly against the action of said return spring, said setting means further comprising an eccentric shaft extending parallel to the cylinder axis along the associated spaced rails and which is able to be turned by means of a turning device and locked by means of a clamping device.

13. The folder as claimed in claim 12, wherein said eccentric shafts comprise lateral drive wheels and wherein said drive wheels provided adjacent to a cylinder end are in engagement with a common setting ring coaxial to the cylinder axis, said setting ring comprising racks associated with the drive wheels for cooperation therewith and spaced out by circumferential recesses into which the folding member fit, said setting ring further comprising internal gear teeth and a setting wheel meshing with said internal gear teeth.

14. The folder as claimed in claim 9, wherein said folding cylinders are subdivided centrally and in each resulting cylinder section is provided separately operated folding members, the adjustable circumferential sections being adjustable in a radial direction with the adjacently placed cylinder sections being able to be separately operated.

15. The folder as claimed in claim 14, wherein said setting means moves said spaced rails outwardly against the action of a return spring, the adjustable circumferential sections being adjustable in a radial direction and comprising said spaced rails, said setting means further comprising an eccentric shaft extending parallel to the cylinder axis along the associated spaced rails, said eccentric shaft being fully extended along the width of the associated cylinder section and being arranged to be driven from an opposite cylinder end surface.

* * * * *